US007555134B2

(12) United States Patent
Dunn et al.

(10) Patent No.: US 7,555,134 B2
(45) Date of Patent: Jun. 30, 2009

(54) ANTENNA FOR MINIATURE WIRELESS DEVICES AND IMPROVED WIRELESS EARPHONES SUPPORTED ENTIRELY BY THE EAR CANAL

(75) Inventors: William Frank Dunn, Austin, TX (US); Timothy Milam, Georgetown, TX (US); Kelly Kodama, Alamo, CA (US); Mead Killion, Elk Grove Village, IL (US); Viorel Drambarean, Skokle, IL (US); David Michael Friesema, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

(21) Appl. No.: 11/848,802

(22) Filed: Aug. 31, 2007

(65) Prior Publication Data

US 2008/0056526 A1 Mar. 6, 2008

Related U.S. Application Data

(60) Provisional application No. 60/824,433, filed on Sep. 1, 2006.

(51) Int. Cl.
*H04R 5/02* (2006.01)
*H04R 25/00* (2006.01)

(52) U.S. Cl. ..... 381/309; 381/380

(58) Field of Classification Search ..... 381/23.1, 381/79, 309, 311, 312, 315, 322, 324, 328, 381/370, 374, 380, 384
See application file for complete search history.

(56) References Cited

U.S. PATENT DOCUMENTS 4,634,815 A * 1/1987 Marquis ..... 381/328
5,298,692 A 3/1994 Ikeda et al.
5,479,522 A 12/1995 Lindemann et al.
5,715,321 A 2/1998 Andrea et al.
6,129,175 A 10/2000 Tutor et al.
6,175,633 B1 1/2001 Morrill et al.
6,208,740 B1 * 3/2001 Grever ..... 381/79
6,430,217 B1 8/2002 Suzuki et al.
6,513,621 B1 2/2003 Deslauriers et al.
RE38,351 E 12/2003 Iseberg et al.
6,729,726 B2 5/2004 Miller et al.
6,940,988 B1 * 9/2005 Shennib et al. ..... 381/322
6,993,144 B1 1/2006 Wilson et al.
6,995,715 B2 * 2/2006 Ying et al. ..... 455/550.1
2002/0131585 A1 9/2002 Jones et al.
2003/0081803 A1 * 5/2003 Petilli et al. ..... 381/314
2004/0165720 A1 8/2004 Paulson et al.
2006/0120546 A1 6/2006 Tanaka et al.
2007/0086600 A1 * 4/2007 Boesen ..... 381/79

* cited by examiner

*Primary Examiner*—Brian Ensey
(74) *Attorney, Agent, or Firm*—McAndrews, Held & Malloy, Ltd.

(57) ABSTRACT

Wireless earphone systems provide earphones configured to be supported entirely by the ear canals of the wearer and to provide stereophonic reproduction of sound to the wearer based on a two-channel stereophonic signal from a transceiver that is attachable to a device. Certain systems include earphones configured such that channel reception can be switched between the earphones. Certain systems include an earphone that includes: a housing; a ground plane comprising circuitry; and a multi-segmented antenna configured to receive a signal from a transceiver, wherein the antenna and the ground plane are disposed within the housing, wherein the antenna is substantially parallel to the ground plane, and wherein the antenna and the ground plane are separated by a distance.

28 Claims, 6 Drawing Sheets

ANTENNA FOR MINIATURE WIRELESS DEVICES AND IMPROVED WIRELESS EARPHONES SUPPORTED ENTIRELY BY THE EAR CANAL

CROSS-REFERENCE TO RELATED APPLICATIONS/INCORPORATION BY REFERENCE

This application claims priority to U.S. Provisional Application No. 60/824,433 filed Sep. 1, 2006, entitled "IMPROVED ANTENNA FOR MINIATURE WIRELESS DEVICES AND IMPROVED WIRELESS EARPHONES SUPPORTED ENTIRELY BY THE EAR CANAL," which application is incorporated by reference herein in its entirety.

BACKGROUND OF THE INVENTION

Certain embodiments of the present technology relate to wireless devices. More specifically, certain embodiments of the present technology relate to wireless earphone systems used in connection with devices that can output an audio signal.

The use of wireless speakers and earphones is well known. There are, however, several disadvantages associated with existing wireless earphone systems. For example, existing wireless earphones do not sufficiently exclude external noise. As a result, in order for an earphone user to enjoy music and/or understand speech, the earphone user increases the earphone volume to uncomfortable and/or unsafe levels. This issue can be exacerbated, for example, when an earphone user is on a train, in an automobile, on an airplane, using the subway, and/or on a busy street.

Another example of a disadvantage associated with existing wireless earphones is that they provide relatively poor sound quality and fidelity. The noise level of existing wireless earphones is almost always higher than that of the MP3 player or other audio source itself. Also, existing wireless earphones have 25-band Accuracy Scores of about 30-79%, whereas wired earphones that listeners rate as true high-fidelity have 25-band Accuracy Scores of 80% and greater.

Another example of a disadvantage associated with existing wireless earphones is that they are relatively bulky and heavy. As a result, a headband and/or other support means is used to secure the earphones near the ears, thereby reducing earphone user comfort and making earphones less convenient to wear and/or carry.

Many factors contribute to earphone size and weight. Such factors include circuitry size, battery size, and antenna size. While circuits and batteries continue to become smaller and more lightweight, antennas require unique consideration. For example, a quarter-wave antenna operating at 2.4 GHz requires about 31.25 mm of effective length when it is free from nearby conductors and operates above a real or virtual ground plane. In practice, such a condition arises when the antenna extends from a circuit board, which acts as a ground plane, such that the antenna is substantially perpendicular to the plane created by the surface of the circuit board. Even shorter antennas can sometimes be used with special methods, but all require 25-32 mm of relatively free space inside the earphone housing. The required free space inside the earphone housing contributes substantially to the total volume of the earphone. In such applications, disposing an antenna in an earphone housing can increase the size of the earphone housing by a factor of about 25 mm times the surface area of the housing, resulting in a device that is substantially larger than it would be without the antenna.

In other applications, a quarter-wave antenna can be placed above and substantially parallel to the ground plane formed by the circuit board. In general, the antenna is placed a distance of at least 6 mm from the ground plane (and often 10 mm from the ground plane) in order to avoid antenna efficiency losses.

In other applications, the antenna may be arranged to stick out of the earphone housing in whole or in part (for example, as is the case with many cell phones). However, it is sometimes undesirable to have the antenna stick out of the earphone housing, and such applications can result in a device that is substantially larger than it would be without the antenna.

The most promising recent wireless technology has been Bluetooth, an industrial specification for wireless personal area networks. The early Bluetooth circuits were large and required large battery currents. However, more recent Bluetooth circuits are smaller and exhibit reduced power drain. Further, battery energy storage density continues to improve.

Such improvements have resulted in further development of wireless earphones. For example, Teling Technology Company, has announced a wireless cellular phone headset, the BTH-11, that does not require a headband and/or other support means, and appears to be supported only by the ear. However, the BTH-11 headset is for a low-quality monaural telephone audio signal rather than a high-fidelity stereophonic signal. Such a headset would not include the amount of circuitry found in a stereophonic headset, which, for example, requires a higher signal to noise ratio and processes more data. Further, battery consumption would be as little as half that of a stereophonic headset. Nonetheless, the BTH-11 headset is relatively bulky. It has listed dimensions of 75.2 mm×17 mm×33 mm, resulting in a volume of 42,187 cubic mm, and appears to require parking in a belt-holder to recharge the battery in the headset. Further, while the ear tips shown in connection with the BTH-11 headset appear adequate for monaural telephonic reproduction, they would not have the stability or sealing properties required for true high-fidelity stereophonic reproduction, for example, because they do not appear to have a length, width or design that would allow them to substantially acoustically seal an ear canal.

Further limitations and disadvantages of conventional and traditional approaches will become apparent to one of skill in the art, through comparison of such systems with some aspects of the present technology as set forth in the remainder of the present application with reference to the drawings. There is, therefore, a need for wireless earphone systems that provide improved external noise exclusion, improved sound quality and fidelity, and/or reduced size and weight.

BRIEF SUMMARY OF THE INVENTION

Certain embodiments of the present technology provide wireless earphone systems comprising: a transceiver configured to wirelessly transmit a two-channel stereophonic signal; a first earphone comprising a first tip configured to be inserted into a first ear canal of a wearer, wherein the first earphone is configured to receive a first channel of the two-channel stereophonic signal from the transceiver; and a second earphone comprising a second tip configured to be inserted into a second ear canal of the wearer, wherein the second earphone is configured to receive a second channel of the two-channel stereophonic signal from the transceiver, and wherein the first earphone and the second earphone together provide stereophonic reproduction of sound to the wearer based on the two-channel stereophonic signal from the transceiver when the tips are inserted into the ear canals of the wearer.

In certain embodiments, for example, the earphones are supported entirely by the ear canals when the tips are inserted into the ear canals of the wearer.

In certain embodiments, for example, at least one of the first earphone and the second earphone includes a housing with an external volume that is about 7700 cubic millimeters or less.

In certain embodiments, for example, at least one of the first earphone and the second earphone weigh 14 grams or less.

In certain embodiments, for example, the first earphone and the second earphone together provide moderate high-fidelity stereophonic reproduction of sound to the wearer based on the two-channel stereophonic signal from the transceiver when the tips are inserted into the ear canals of the wearer.

In certain embodiments, for example, the first earphone and the second earphone together provide true high-fidelity stereophonic reproduction of sound to the wearer based on the two-channel stereophonic signal from the transceiver when the tips are inserted into the ear canals of the wearer such that the ear canals are substantially acoustically sealed.

In certain embodiments, for example, at least one of the first earphone and the second earphone excludes external noise greater than thirty decibels from entering an ear canal of the wearer when the earphone tip is inserted into the ear canal such that the ear canals are substantially acoustically sealed.

In certain embodiments, for example, the first earphone and the second earphone are configured such that channel reception can be switched so that the first earphone receives the second channel of the two-channel stereophonic signal and the second earphone receives the first channel of the two-channel stereophonic signal.

In certain embodiments, for example, the transceiver is configured to be attachable to a portable device.

Certain embodiments of the present technology provide wireless earphone systems comprising: a transceiver configured to wirelessly transmit a two-channel stereophonic signal; and an earphone configured to receive the two-channel stereophonic signal from the transceiver and provide reproduction of sound to a wearer based on the two-channel stereophonic signal from the transceiver, the earphone comprising: an H-bridge output; and a transducer configured to convert a digital signal to sound, wherein the H-bridge output is configured to direct drive the transducer.

Certain embodiments of the present technology provide wireless earphone systems comprising: a transceiver configured to wirelessly transmit a signal; and an earphone comprising: a tip configured to be inserted into an ear canal of a wearer; a housing; a ground plane comprising circuitry; and a multi-segmented antenna configured to receive the signal from the transceiver, wherein the antenna and the ground plane are disposed within the housing, wherein the antenna is substantially parallel to the ground plane, and wherein the antenna and the ground plane are separated by a distance that is 5 millimeters or less.

In certain embodiments, for example, the ground plane is disposed at a first end of the housing, certain portions of the circuitry protrude beyond the ground plane, and the antenna is disposed within the housing such that an upper surface of the antenna is at the same height or below the top height of the portions of the circuitry protruding beyond the ground plane, thereby allowing the antenna to be disposed within the housing without requiring an increase in the volume of the housing.

In certain embodiments, for example, the ground plane is disposed at a first end of the housing, certain portions of the circuitry protrude beyond the ground plane, and the antenna follows a tortuous path around the portions of the circuitry protruding beyond the ground plane.

In certain embodiments, for example, the circuitry includes at least one of: a printed circuit board, a switch, a light emitting diode, and a charging socket.

In certain embodiments, for example, the antenna is c-shaped.

In certain embodiments, for example, the antenna has a total physical length that is about 57 millimeters or less and has an effective length that is about 32 millimeters or more.

In certain embodiments, for example, the earphone further includes a contact member configured to be attachable to the antenna, wherein during assembly of the earphone, the contact member guides antenna placement in the earphone.

Various advantages, aspects and novel features of the present invention, as well as details of an illustrated embodiment thereof, will be more fully understood from the following description and drawings.

Figure 1:
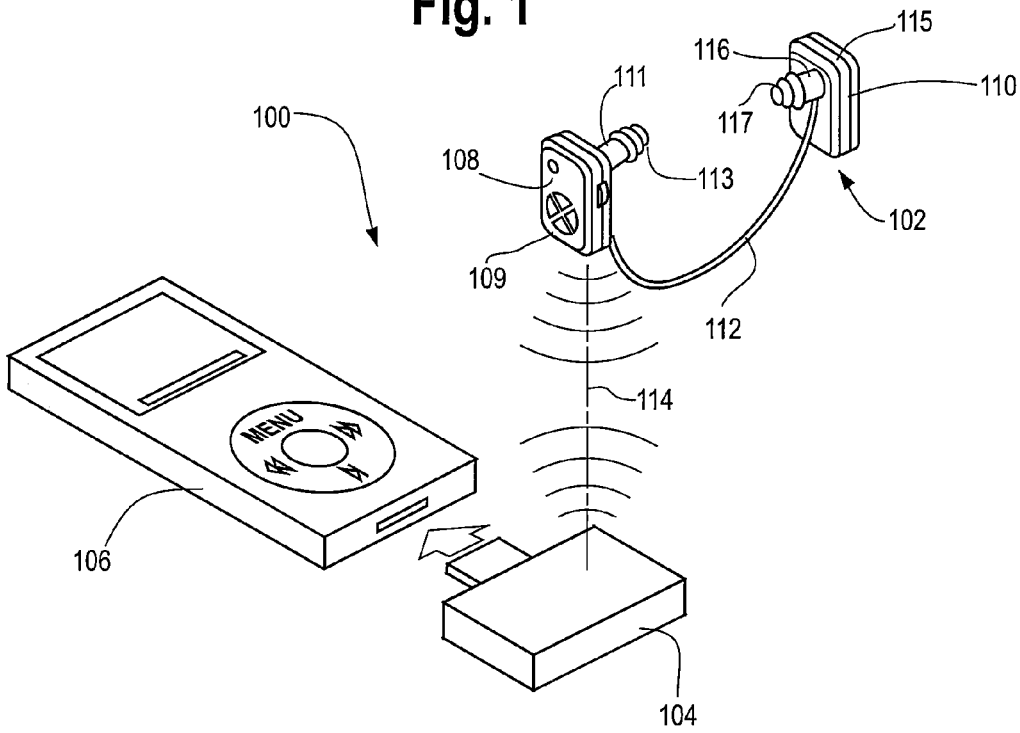
FIG. 1 is a perspective view of a wireless earphone system used in accordance with an embodiment of the present technology.

The foregoing summary, as well as the following detailed description of embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings. In connection with the drawings, like elements are indicated with like identifiers.

DETAILED DESCRIPTION OF THE INVENTION

FIG. 1 is a perspective view of a wireless earphone system 100 used in accordance with an embodiment of the present technology. The system 100 includes wireless earphones 102, a transceiver 104 and a portable device 106. The wireless earphones 102 include a right earphone 108, a left earphone 110, and a wire 112 that connects the right earphone 108 and the left earphone 110. The right earphone 108 includes a housing 109, a sound port 111, and a tip 113. Similarly, the left earphone 110 includes a housing 115, a sound port 116, and a tip 117. In the system 100, the transceiver 104 is configured to be attachable to the portable device 106 and to wirelessly transmit a two-channel stereophonic signal 114 from the portable device 106 to the wireless earphones 102. The right earphone 108 is configured to receive one channel of the two-channel stereophonic signal 114 from the transceiver 104 and produce sound based on that channel. The right earphone 108 emits sound through the sound port 111. The left earphone 110 is configured to receive the other channel of the two-channel stereophonic signal 114 from the transceiver 104 and produce sound based on that channel. The left earphone 110 emits sound through the sound port 116. The right earphone 108 and the left earphone 110 can be used together to provide stereophonic reproduction of sound to a wearer based on the two-channel stereophonic signal from the transceiver 104 when their respective tips 113, 117 are inserted into the ear canals of the wearer.

In the embodiment shown in FIG. 1, the right earphone 108 includes a tip 113 configured to be disposed on an outer surface of a sound port 111 and inserted into an ear canal of a wearer. Similarly, the left earphone 110 includes a tip 117 configured to be disposed on an outer surface of a sound port 116 and to be inserted into an ear canal of a wearer. The tips 113, 117 each comprise a resilient sealing member configured to conform to the ear canal of a wearer, much like an ear plug, thereby substantially acoustically sealing the ear canal. The earphones 108 and 110 can thereby exclude external noise greater than 30 decibels from entering the ear canals of a wearer when the tips 113, 117 are inserted into the ear canals such that the ear canals are substantially acoustically sealed. Also, in certain embodiments, the earphones 108, 110 can exclude external noise between about 35 decibels and about 40 decibels from entering the ear canals of a wearer when the tips 113, 117 are inserted into the ear canals such that the ear canals are substantially acoustically sealed.

For example, in certain embodiments, the tips 113, 117 can be of the form of the resilient sealing member shown and described in U.S. Pat. No. Re. 38,351, which issued to Iseberg et al. on Dec. 16, 2003, and is incorporated by reference herein in its entirety. Such a tip can include multiple flanges and can be of a size and shape that allows the tip to be inserted into the ear canal such that the ear canal is substantially acoustically sealed. For example, in certain embodiments, the tips 113, 117 can be of the form of a resilient sealing member comprising a cylindrical foam ear plug with a hole therethrough to accommodate a sound outlet. Such a tip can be of a size and shape that allows the tip to be inserted into the ear canal such that the ear canal is substantially acoustically sealed.

In the embodiment shown in FIG. 1, the right earphone 108 and the left earphone 110 are connected by a wire 112. The right earphone 108 includes circuitry and an antenna (not shown in FIG. 1), which are shown and further discussed in connection with FIGS. 14-16. The antenna receives the two-channel stereophonic signal 114 from the transceiver 104. The circuitry directs the two-channel stereophonic signal 114 from the transceiver 104. One channel is directed to the right earphone 108. The other channel is directed to the left earphone 110 via the wire 112. The left earphone 110 includes a battery (not shown). The battery provides power to the left earphone 110. The battery provides power to the right earphone 108 via the wire 112.

In certain embodiments, the circuitry and antenna of the right earphone 108 can be configured to wirelessly transmit control information to the transceiver 104 and form a bi-directional wireless link with the transceiver 104. In such embodiments, buttons on the right earphone 108 can be used by an earphone user to input control information to the right earphone 108.

In certain embodiments, the right earphone and the left earphone are not connected by a wire. In such embodiments, both earphones include circuitry, an antenna, and a battery. In such embodiments, the right earphone receives the two-channel stereophonic signal from the transceiver using its antenna and then produces sound based on one channel. The left earphone receives the two-channel stereophonic signal from the transceiver using its antenna and then produces sound based on the other channel. The right earphone is powered by its battery and the left earphone is powered by its battery.

In certain embodiments of the present technology, a wireless transceiver transmits a digital two-channel stereophonic signal from a device. An antenna disposed in an earphone receives the signal. The signal is output to a receiver module comprising circuitry including a printed circuit board and a CODEC. The CODEC optimizes the signal. Signal optimization requirements can vary based on the application and is within the knowledge of one skilled in the art. Signal optimization can affect noise level, distortion, dynamic range, and frequency response. The optimized signal is output to a transducer that converts the signal into sound. The sound is output to a sound outlet and damping is provided by a damper. Transducer and damper combinations used in connection with providing high-fidelity stereophonic sound reproduction in wired earphone systems are shown and described in U.S. Pat. No. Re. 38,351, which issued to Iseberg et al. on Dec. 16, 2003. The sound outlet can have a tip disposed thereon that can be inserted into the ear canal such that the ear canal is substantially acoustically sealed. Sound can be output to the ear canal from the sound outlet through the tip.

As used herein, low fidelity refers to sound reproduction that has a 25-band accuracy score of less than 40%; moderate high fidelity refers to sound reproduction that has a 25-band accuracy score of 40-79%; and true high fidelity refers to sound reproduction that has a 25-band accuracy score of at least 80%. In certain embodiments, the right earphone 108 and the left earphone 110 can be used together to provide moderate high-fidelity stereophonic reproduction of sound to a wearer based on the two-channel stereophonic signal 114 from the transceiver 104 when their respective tips 113, 117 are inserted into the ear canals of the wearer. In certain embodiments, the right earphone 108 and the left earphone 110 can be used together to provide true high-fidelity stereophonic reproduction of sound to a wearer based on the two-channel stereophonic signal 114 from the transceiver 104 when their respective tips 113, 117 are inserted into the ear canals of the wearer such that the ear canals are substantially acoustically sealed.

In order to achieve moderate and/or true high-fidelity, the noise levels of earphones used in accordance with certain embodiments of the present technology have been reduced in comparison to the noise levels of typical wireless earphones. For example, it has been discovered that typical wireless earphones have increased noise levels due at least in part to the use of chip sets with integral CODECs. It has also been discovered that using a chip set with a separate CODEC in a wireless earphone does not increase noise levels as much. Thus, in order to reduce earphone noise levels, and thereby increase sound quality and fidelity, earphones used in accordance with certain embodiments of the present technology use a chip set with a separate CODEC. For example, in certain embodiments, wireless earphones of the present technology can include a Broadcom 2037 chip set with a separate Wolfson 8750 CODEC.

As another example, it has been discovered that typical wireless earphones receive signals at a variable digital level, thereby requiring the receive gain to be set so high (for example, at full scale) that the receive gain creates noise. Increased receive gain noise can result in reduced sound quality and fidelity. It has also been discovered that receiving signals at a digital level of digital full scale allows the receive gain to be set lower (for example, at a user set variable level), such that receive gain noise is reduced or eliminated. Thus, in order to reduce earphone noise levels, and thereby increase sound quality and fidelity, earphones used in accordance with certain embodiments of the present technology receive signals at a digital level of digital full scale.

The base resonance of earphones used in accordance with certain embodiments of the present technology has also been improved. For example, it has been discovered that using an H-bridge output or equivalent output configured to direct drive a transducer can provide improved base resonance. For example, in certain embodiments, the H-bridge output can include two direct current outputs facing each other that are substantially balanced. In certain embodiments, such a configuration can provide improved base resonance.

In the embodiment shown in FIG. 1, the right earphone 108 is of a size and weight that allows the earphone 108 to be supported entirely by an ear canal of a wearer when the tip 113 is inserted into the ear canal. Similarly, the left earphone 110 is of a size and weight that allows the earphone 110 to be supported entirely by an ear canal of a wearer when the tip 117 is inserted into the ear canal. For example, in certain embodiments, the right earphone 108 weighs about 14 grams or less and the left earphone 110 weighs about 14 grams or less, and both the right earphone 108 and the left earphone 110 include respective housings 109, 115 that have external dimensions of 35 mm×22 mm×10 mm, resulting in external housing volumes of 7700 cubic mm. In certain embodiments, the antenna configurations shown and described below can allow earphones to be provided that have the size and/or weight characteristics described above. It will be evident to one skilled in the art that smaller housing volumes and lighter earphone weights can be achieved using the teachings herein as circuitry and battery technologies progress and provide for smaller circuitry and smaller batteries.

In the embodiment shown in FIG. 1, for example, the portable device 106 is an iPod®, which is manufactured by Apple, Inc. In certain embodiments, the transceiver can be configured to be attachable to other portable devices and/or non-portable devices that can output an audio signal. In certain embodiments, for example, the transceiver can be configured to be attachable to a device that can output an audio signal that is a two-channel stereophonic signal. In certain embodiments, for example, the transceiver can be configured to be attachable to a device that can output an audio signal that is not a two-channel stereophonic signal.

Figure 2:
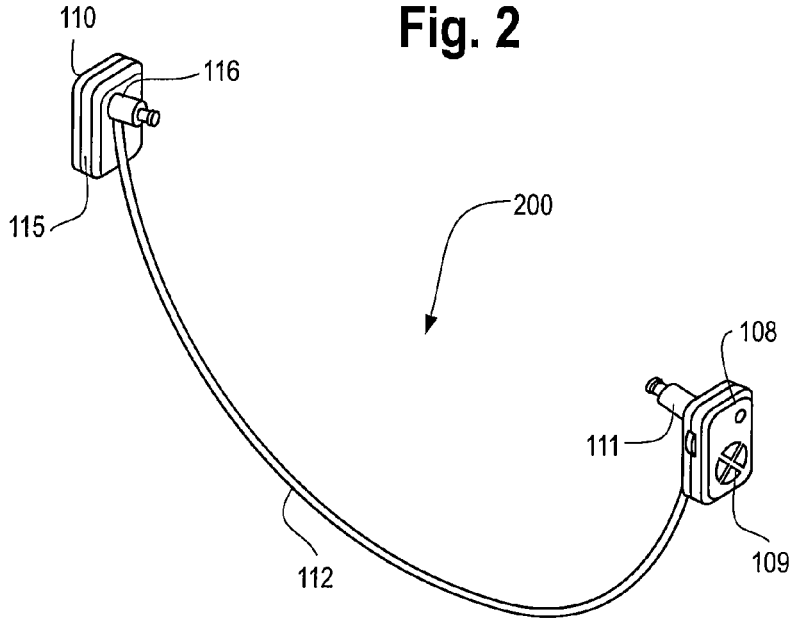
FIG. 2 is a right-side perspective view of the wireless earphones used in accordance with an embodiment of the present technology.
Figure 3:
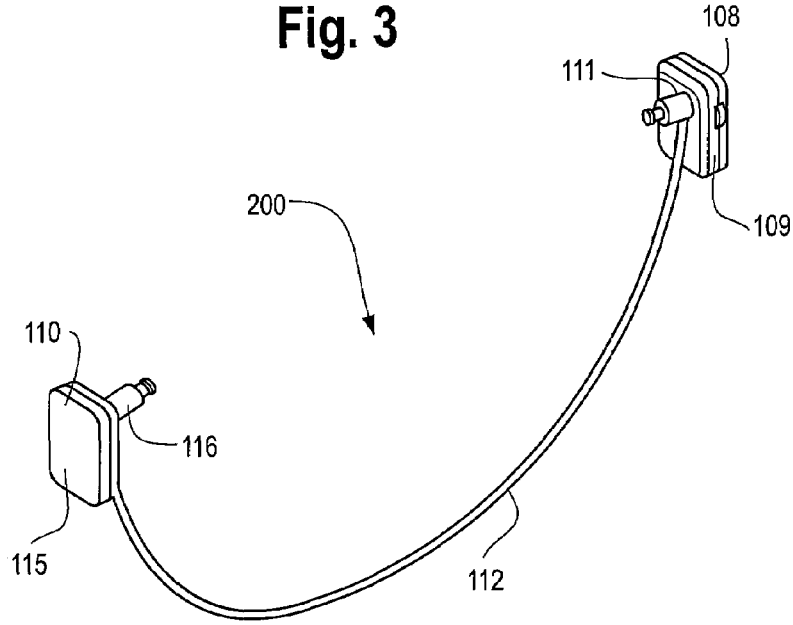
FIG. 3 is a left-side perspective view of the wireless earphones depicted in FIG. 2.
Figure 4:
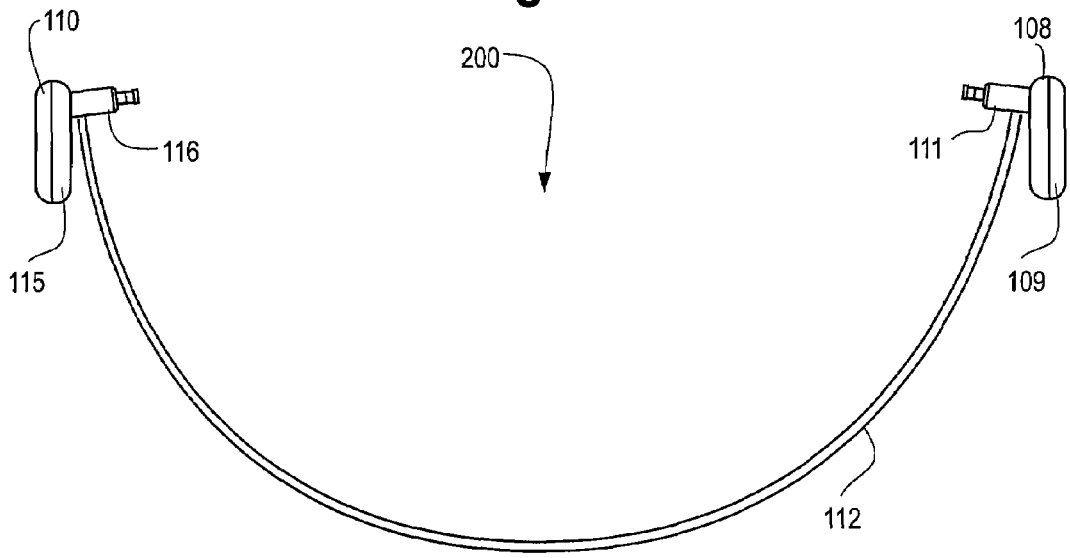
FIG. 4 is a side view of the wireless earphones depicted in FIG. 2.
Figure 5:
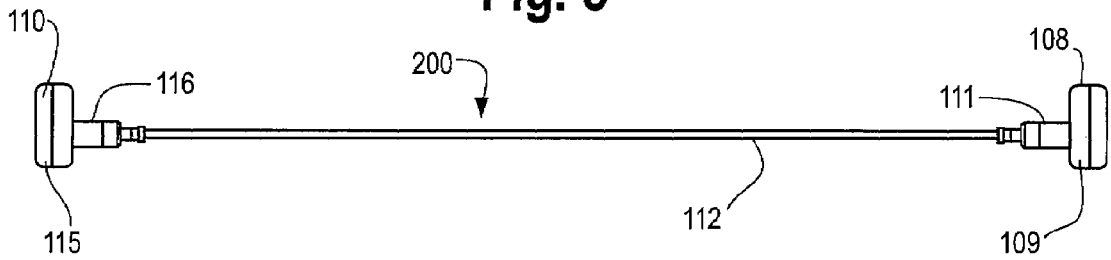
FIG. 5 is a top view of the wireless earphones depicted in FIG. 2.

FIG. 2 is a right-side perspective view of wireless earphones 200 used in accordance with an embodiment of the present technology. FIG. 3 is a left-side perspective view of the wireless earphones depicted in FIG. 2. FIG. 4 is a side view of the wireless earphones depicted in FIG. 2. FIG. 5 is a top view of the wireless earphones depicted in FIG. 2. In certain embodiments, the wireless earphones 200 shown in FIGS. 2-5 can also include tips similar to tips 113 and 117 shown and described in connection with FIG. 1.

Figure 6:
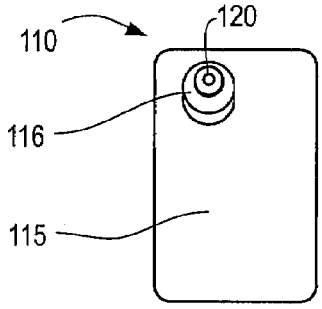
FIG. 6 is a front view of a left earphone used in accordance with an embodiment of the present technology.
Figure 7:
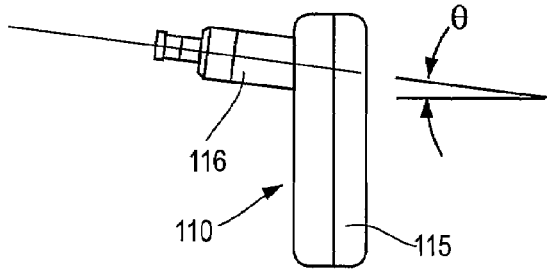
FIG. 7 is a side view of the left earphone depicted in FIG. 6.
Figure 8:
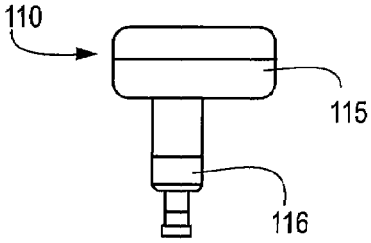
FIG. 8 is a top view of the left earphone depicted in FIG. 6.
Figure 9:
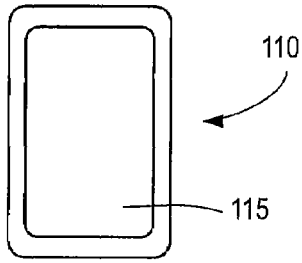
FIG. 9 is a rear view of the left earphone depicted in FIG. 6.

FIG. 6 is a front view of a left earphone 110 used in accordance with an embodiment of the present technology. FIG. 7 is a side view of the left earphone depicted in FIG. 6. FIG. 8 is a top view of the left earphone depicted in FIG. 6. FIG. 9 is a rear view of the left earphone depicted in FIG. 6. In certain embodiments, the left earphone 110 shown in FIGS. 6-9 can also include a tip similar to the tip 117 shown and described in connection with FIG. 1.

It has been discovered that providing sound port and housing configurations that accommodate the internal structure of the ear can provide improved comfort and/or sealing. For example, near the ear openings, ear canals proceed forward (toward the face of an earphone user) and up (toward the top of an earphone user's head). It has been discovered that providing sound port and housing configurations in accordance with embodiments of the present technology that accommodate this structure can provide improved comfort and/or sealing.

In the embodiment shown in FIGS. 6-9, the left earphone 110 includes a sound port 116 with an opening 120 through which sound is communicated from the left earphone 110 to the ear canal of an earphone user. As shown, for example, in FIG. 6, the sound port 116 extends from a flat front portion of the housing 115 near the upper left corner of the flat front portion of the housing 115. As shown, for example, in FIG. 7, the sound port 116 extends form the flat front portion of the housing 115 at an angle θ between a line perpendicular to the plane created by the flat front portion of the housing 115 and a line that runs through the center of the sound port 116. In the embodiment shown in FIGS. 6-9, θ is about 7.5 degrees. Although no two ears are exactly alike, an angle of about 7.5 degrees between the flat front portion of the housing 115 and the sound port 116 can be adequate for numerous users. In certain embodiments, an angle between about 7 degrees and about 10 degrees between the flat front portion of the housing 115 and the sound port 116 can be adequate for numerous users.

In certain embodiments, the sound port 116 can be located in a different position in order to provide for improved performance and/or comfort. For example, in certain embodiments, the sound port 116 can extend from the flat front portion of the housing 115 near the upper right corner, the lower left corner, or the lower right corner of the flat front portion of the housing 115. In certain embodiments, the sound port 116 can be movable between various positions to provide for improved performance and/or comfort. For example, in certain embodiments, the sound port 116 can be movable between any of the locations previously described.

Figure 10:
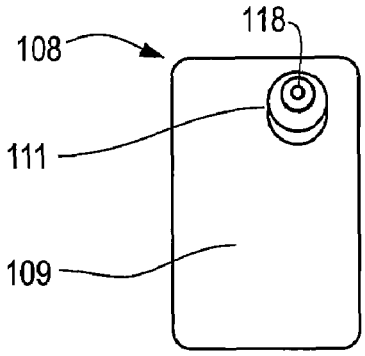
FIG. 10 is a front view of a right earphone used in accordance with an embodiment of the present technology.
Figure 11:
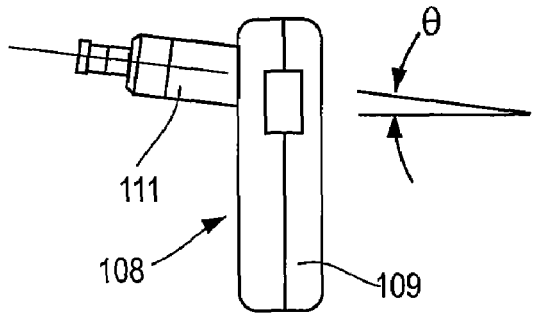
FIG. 11 is a side view of the right earphone depicted in FIG. 10.
Figure 12:
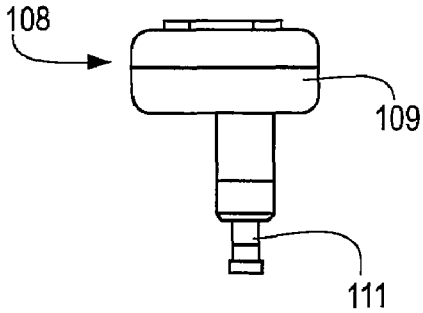
FIG. 12 is a top view of the right earphone depicted in FIG. 10.
Figure 13:
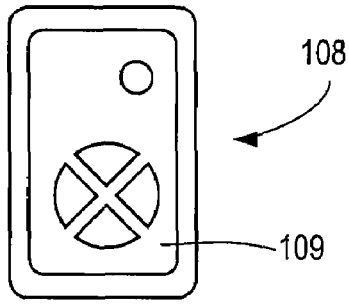
FIG. 13 is a rear view of the right earphone depicted in FIG. 10.

FIG. 10 is a front view of a right earphone used in accordance with an embodiment of the present technology. FIG. 11 is a side view of the right earphone depicted in FIG. 10. FIG. 12 is a top view of the right earphone depicted in FIG. 10. FIG. 13 is a rear view of the right earphone depicted in FIG. 10. In certain embodiments, the right earphone 108 shown in FIGS. 10-13 can also include a tip similar to the tip 113 shown and described in connection with FIG. 1.

In the embodiment shown in FIGS. 10-13, the right earphone 108 includes a sound port 111 with an opening 118 through which sound is communicated from the right earphone 108 to the ear canal of an earphone user. As shown, for example, in FIG. 10, the sound port 111 extends from a flat front portion of the housing 109 near the upper right corner of the flat front portion of the housing 109. As shown, for example, in FIG. 11, the sound port 111 extends form the flat front portion of the housing 109 at an angle θ between a line perpendicular to the plane created by the flat front portion of the housing 109 and a line that runs through the center of the sound port 111. In the embodiment shown in FIGS. 10-13, θ is about 7.5 degrees. Although no two ears are exactly alike, an angle of about 7.5 degrees between the flat front portion of the housing 109 and the sound port 111 can be adequate for numerous users. In certain embodiments, an angle between about 7 degrees and about 10 degrees between the flat front portion of the housing 109 and the sound port 111 can be adequate for numerous users.

In certain embodiments, the sound port 111 can be located in a different position in order to provide for improved performance and/or comfort. For example, in certain embodiments, the sound port 111 can extend from the flat front portion of the housing 109 near the upper left corner, the lower left corner, or the lower right corner of the flat front portion of the housing 109. In certain embodiments, the sound port 111 can be movable between various positions to provide for improved performance and/or comfort. For example, in certain embodiments, the sound port 111 can be movable between any of the locations previously described.

In embodiments where the left earphone sound port 116 and the right earphone sound port 111 are not movable between various positions, reversing the earphones (left earphone 110 in right ear and right earphone 108 in left ear) can provide a second sound port position (effectively moving the sound port from one side of the flat front portion of the housing to the other). Further, in certain embodiments, the left earphone and the right earphone can be configured such that channel reception can be switched so that the left earphone receives the right channel of the two-channel stereophonic signal and the right earphone receives the left channel of the two-channel stereophonic signal. For example, in certain embodiments, software, hardware, firmware, or a combination thereof, can be employed that allows an earphone user to reverse the two-channel signal direction by entering a sequence on buttons on an earphone. An example of such a sequence is: press and hold the Track Back button then press the Track Forward button. While still holding the Track Back button down, release the Track Forward button, and then release the Track Back button. At the end of the sequence, the left-channel signal that was directed to the left earphone is directed to the right earphone, which can be worn on the left ear. Similarly, the right-channel signal that was directed to the right earphone is directed to the left earphone, which can be worn on the right ear. Similarly, channel reception can be switched back to the original setting by entering the sequence again.

In certain embodiments, the buttons described above are located on a right earphone. However, an earphone user may prefer to access the buttons on the left ear. Employing the software, hardware, firmware, or combination thereof, described above can allow the earphone user to reverse the two-channel signal direction and use the right earphone in the left ear, thereby providing the buttons on the left ear. Such functionality may provide substantial inventory cost savings (as opposed to making right earphones with buttons and making left earphones with buttons), as well as avoiding two SKU units in retail stores.

Figure 14:
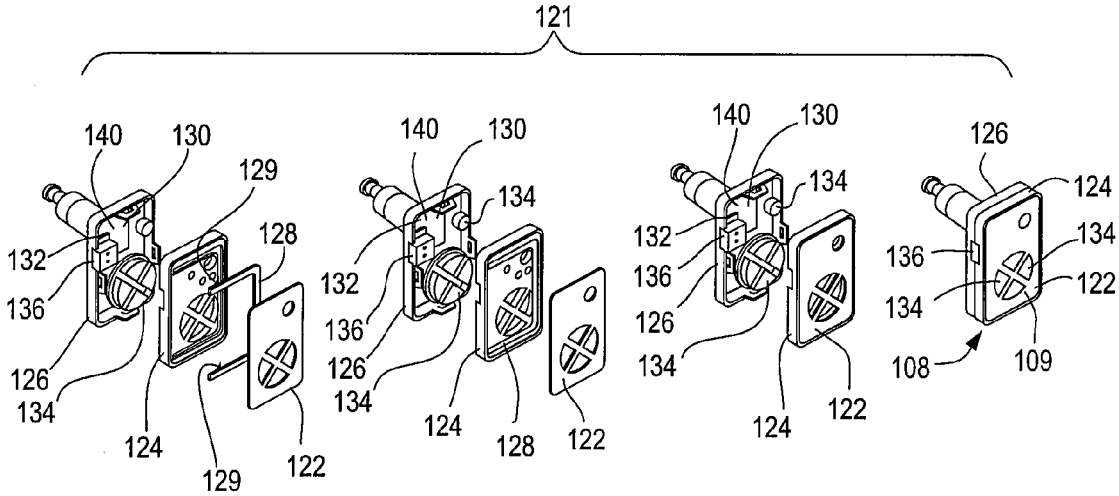
FIG. 14 is a rear perspective view that illustrates assembly steps of the right earphone depicted in FIG. 10.
Figure 15:
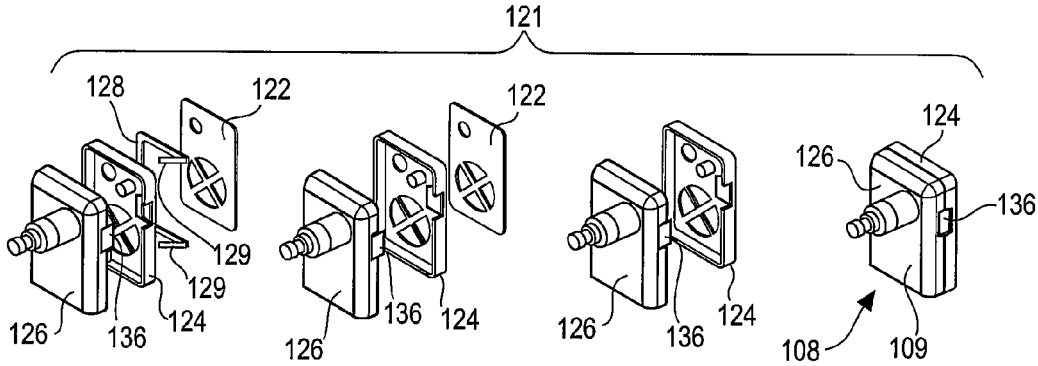
FIG. 15 is a front perspective view that illustrates assembly steps of the right earphone depicted in FIG. 10.

FIG. 14 is a rear perspective view that illustrates assembly steps 121 of the right earphone 108 depicted in FIG. 10. FIG. 15 is a front perspective view that illustrates assembly steps 121 of the right earphone 108 depicted in FIG. 10. In the embodiment shown in FIGS. 14 and 15, the right earphone 108 includes a housing 109 that includes an overlay 122, a front cover 124, and a rear cover 126. Disposed inside the housing 109 are an antenna 128 with spring contacts 129, and circuitry 130. The circuitry 130 includes a printed circuit board 132, switches (not shown) with corresponding buttons 134, a charging socket 136 configured to receive a universal serial bus plug (not shown), and a light emitting diode 140.

Working left to right among the assembly steps 121 shown in FIGS. 14 and 15, the rear cover 126 is provided with circuitry 130 disposed therein. The front cover 124, the antenna 128 with spring contacts 129, and the overlay 122 are also provided. The antenna 128 with spring contacts 129 is pressed into place against the front cover 124 such that the spring contacts 129 guide the antenna into position on the front cover 124 in a trough configured to receive the antenna 128, thereby allowing for blind assembly of the antenna 128 and the front cover 124. It has been discovered that this type of assembly can avoid potential damage to the circuitry 130 that can occur during soldering operations and can also simplify the manufacturing process. The overlay 122 is then pressed into place over the front cover 124 such that the antenna 128 is disposed between the overlay 122 and the front cover 124. The front cover 124 is then pressed into place over the rear cover 126 such that the circuitry 130 is disposed between the rear cover 126 and the front cover 124. In certain embodiments, the front cover 124 can be pressed into place over the rear cover 126 before the antenna 128 is pressed into place against the front cover 124 and/or before the overlay 122 is pressed into place over the front cover 124.

In the embodiment shown in FIGS. 14 and 15, the overlay 122, front cover 124, and rear cover 126 form a housing 109 in which the circuitry 130 and the antenna 128 are disposed. In the embodiment shown in FIGS. 14 and 15, the antenna 128 is configured such that its presence in the housing 109 does not require an increase in the volume of the housing 109. Rather, the antenna 128 is multi-segmented (for example, not a straight line antenna) and conforms to the length, width, and thickness requirements of the housing 109 as dictated by the circuitry 130. That is, the antenna 128 only occupies space that was unused by the circuitry, without requiring the volume of the housing 109 to be increased. As a result, the volume of the housing 109 is dictated by the circuitry 130, and not by the antenna 128.

In the embodiment shown in FIGS. 14 and 15, the circuitry 130 creates a ground plane. The antenna 128 is disposed substantially parallel to the ground plane a distance of about 5 mm from the ground plane. In certain embodiments, the antenna 128 can be disposed substantially parallel to the ground plane a distance less than 5 mm from the ground plane. Providing the antenna 128 parallel to the ground plane reduces the effective length of the antenna 128 to about 55% of the total physical length of the antenna 128. However, it has been discovered that providing a multi-segmented antenna parallel to a ground plane can provide adequate effective antenna length without increasing the volume of a wireless earphone housing.

For example, in certain embodiments, a wireless earphone housing can include circuitry that requires certain minimum housing dimensions. A ground plane comprising circuitry can be disposed at one end of the housing, with certain portions of the circuitry protruding beyond the ground plane. An antenna can be disposed parallel to the ground plane a distance away from the ground plane such that the upper surface of the antenna is at the same height or below the top height of the portions of the circuitry protruding beyond the ground plane. Further, the antenna can be multi-segmented such that it follows a tortuous path through and/or around the portions of the circuitry protruding beyond the ground plane. Although providing such a configuration goes against traditional design methods, experience, and science, it has been discovered that such a configuration can allow a multi-segmented antenna to be disposed in a wireless earphone housing without increasing the volume of the housing. Further, it has been discovered that providing an antenna within a wireless earphone housing in accordance with embodiments of the present technology can provide antenna efficiency that is comparable to typical wireless earphone systems that use much larger antennas and can provide an antenna that meets established Bluetooth requirements for frequency tuning and bit error rate.

Figure 16:
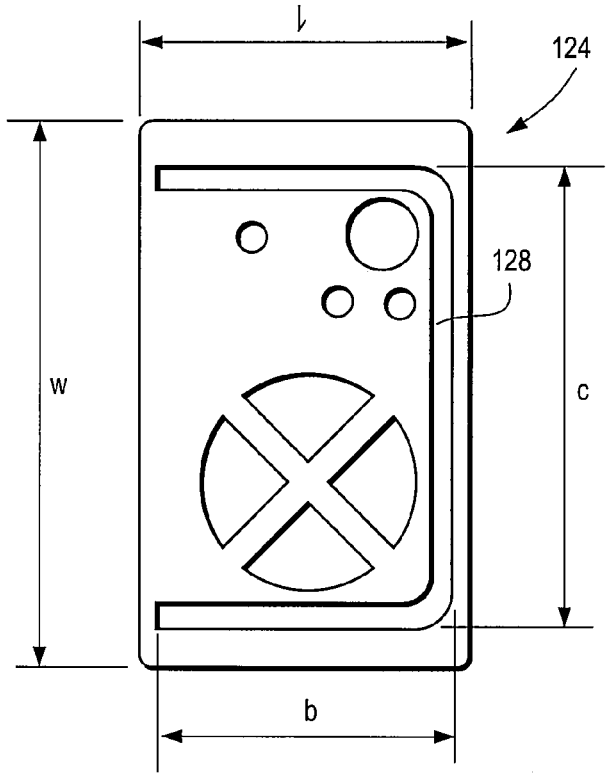
FIG. 16 is a side view of a front cover of a wireless earphone housing with an antenna disposed therein used in accordance with an embodiment of the present technology.

FIG. 16 is a side view of a front cover 124 of a wireless earphone housing with an antenna 128 disposed therein. The front cover 124 has a length l that is about 22 mm and a width w that is about 35 mm. The front cover 124 can be used as part of a housing that has a thickness of about 10 mm. The external volume of such a housing is about 7700 cubic mm. As discussed in connection with FIGS. 14 and 15, the antenna 128 is configured such that its presence in the housing does not require an increase in the volume of the housing. It will be evident to one skilled in the art that even smaller housing volumes can be achieved using the teachings herein as circuitry and battery technologies progress and provide for smaller circuitry and smaller batteries.

In the embodiment shown in FIG. 16, the antenna 128 is multi-segmented and c-shaped, with a side length c of about 27 mm and an arm length b of about 15 mm. The total physical length of the antenna 128 is found by adding the side length c to 2 times the arm length b, which is about 57 millimeters. Due to the reduced effective length, the antenna 128 has an effective length of about 32 millimeters. Because the antenna 128 is multi-segmented and only occupies space that was unused by circuitry, it can provide adequate effective length without increasing the volume of a wireless earphone housing. Further, the multi-segmented antenna 128 can provide antenna efficiency that is comparable to typical wireless earphone systems that use much larger straight line antennas and require larger earphone housings.

In certain embodiments, the multi-segmented antenna can be other shapes, such as z-shaped, j-shaped or v-shaped, for example, depending on the application. In certain embodiments, the antenna can have a total physical length that is greater or less than 57 mm and an effective length that is greater or less than 32 mm. However, current applications require an effective antenna length of about 32 mm.

Figure 17:
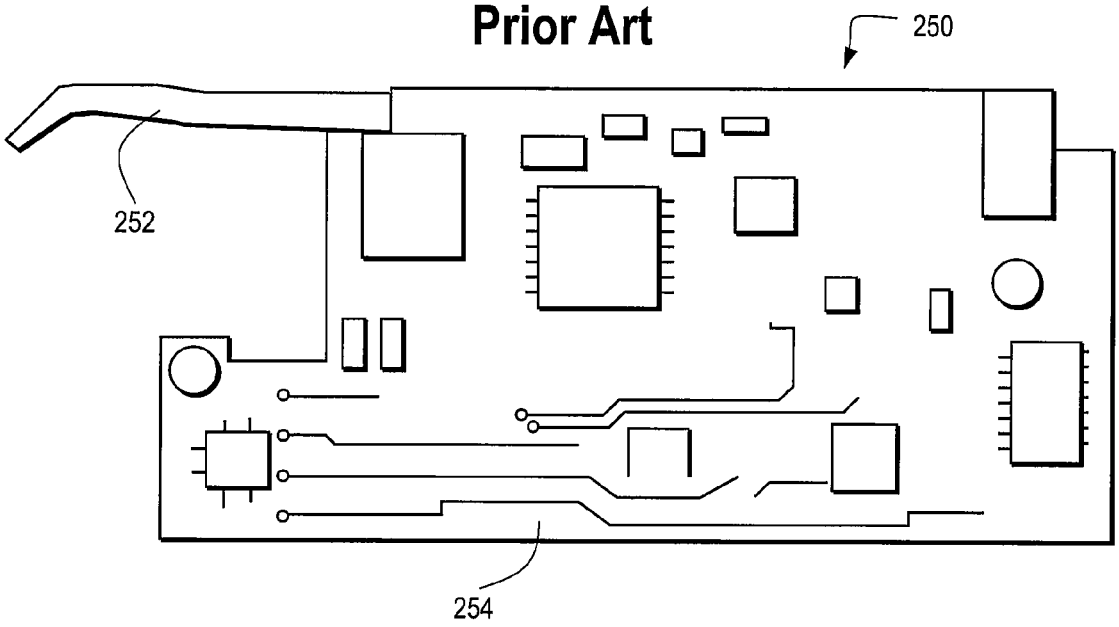
Fig. 17 Prior Art
FIG. 17 is a side view of a prior art wireless earphone component.

FIG. 17 is a side view of a prior art wireless earphone component 250. The earphone component includes an antenna 252 and a printed circuit board 254 that creates a ground plane. The antenna 252 is about 24 mm (including the bent end) and has an effective length of about 32 mm. This is due to the special construction of the antenna 252 and because the antenna 252 sticks out from the end of the printed circuit board 254 rather than being disposed parallel to the printed circuit board 254 a short distance from the printed circuit board 254. The dimensions of the housing that holds the component 250 is about 87 mm×40 mm×12 mm, providing a housing volume of about 41,760 cubic mm, which is much larger than the housings used in accordance with embodiments of the present technology.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A wireless earphone system comprising:

a transceiver configured to wirelessly transmit a two-channel stereophonic signal;

a first earphone comprising a first tip configured to be inserted into a first ear canal of a wearer, wherein the first earphone is configured to receive a first channel of the two-channel stereophonic signal from the transceiver, and wherein the first earphone is configured to be supported entirely by the first ear canal of the wearer when the first tip is inserted into the first ear canal; and a second earphone comprising a second tip configured to be inserted into a second ear canal of the wearer, wherein the second earphone is configured to receive a second channel of the two-channel stereophonic signal from the transceiver, and wherein the second earphone is configured to be supported entirely by the second ear canal of the wearer when the second tip is inserted into the second ear canal, wherein the first earphone and the second earphone together provide stereophonic reproduction of sound to the wearer based on the two-channel stereophonic signal from the transceiver when the tips are inserted into the ear canals of the wearer, and wherein at least one of the first earphone and the second earphone excludes external noise greater than thirty decibels from entering an ear canal of the wearer when the earphone tip is inserted into the ear canal such that the ear canals are substantially acoustically sealed.

2. The system of claim 1, wherein at least one of the first earphone and the second earphone includes a housing with an external volume that is about 7700 cubic millimeters or less.

3. The system of claim 1, wherein at least one of the first earphone and the second earphone weigh 14 grams or less.

4. The system of claim 1, wherein at least one of the first earphone and the second earphone further includes:

a housing;

a ground plane comprising circuitry; and a multi-segmented antenna configured to receive the two-channel stereophonic signal from the transceiver, wherein the antenna and the ground plane are disposed within the housing, wherein the antenna is substantially parallel to the ground plane, and wherein the antenna and the ground plane are separated by a distance that is about 5 millimeters or less.

5. The system of claim 1, wherein the first earphone and the second earphone together provide moderate high-fidelity stereophonic reproduction of sound to the wearer based on the two-channel stereophonic signal from the transceiver when the tips are inserted into the ear canals of the wearer.

6. The system of claim 1, wherein the first earphone and the second earphone together provide true high-fidelity stereophonic reproduction of sound to the wearer based on the two-channel stereophonic signal from the transceiver when the tips are inserted into the ear canals of the wearer such that the ear canals are substantially acoustically sealed.

7. The system of claim 1, wherein the first earphone and the second earphone are configured such that channel reception can be switched so that the first earphone receives the second channel of the two-channel stereophonic signal and the second earphone receives the first channel of the two-channel stereophonic signal.

8. The system of claim 1, wherein the transceiver is configured to be attachable to a portable device.

9. A wireless earphone system comprising:

a transceiver configured to wirelessly transmit a two-channel stereophonic signal;

a first earphone comprising a first tip configured to be inserted into a first ear canal of a wearer, wherein the first earphone is configured to receive a first channel of the two-channel stereo signal from the transceiver; and a second earphone comprising a second tip configured to be inserted into a second ear canal of the wearer, wherein the second earphone is configured to receive a second channel of the two-channel stereo signal from the transceiver, wherein the first earphone and the second earphone are configured such that channel reception can be switched so that the first earphone receives the second channel of the two-channel stereo signal and the second earphone receives the first channel of the two-channel stereo signal, wherein the first earphone and the second earphone together provide stereophonic reproduction of sound to a wearer based on the two-channel stereophonic signal from the transceiver when the earphone tips are inserted into the ear canals of the wearer, and wherein at least one of the first earphone and the second earphone excludes external noise greater than thirty decibels from entering an ear canal of the wearer when the earphone tip is inserted into the ear canal such that the ear canals are substantially acoustically sealed.

10. The system of claim 9, wherein the earphones are supported entirely by the ear canals when the tips are inserted into the ear canals of the wearer.

11. The system of claim 9, wherein at least one of the first earphone and the second earphone further includes:

a housing;

a ground plane comprising circuitry; and a multi-segmented antenna configured to receive the two-channel stereophonic signal from the transceiver, wherein the antenna and the ground plane are disposed within the housing, wherein the antenna is substantially parallel to the ground plane, and wherein the antenna and the ground plane are separated by a distance that is about 5 millimeters or less.

12. The system of claim 9, wherein the first earphone and the second earphone together provide moderate high-fidelity stereophonic reproduction of sound to the wearer based on the two-channel stereophonic signal from the transceiver when the tips are inserted into the ear canals of the wearer.

13. The system of claim 9, wherein the first earphone and the second earphone together provide true high-fidelity stereophonic reproduction of sound to the wearer based on the two-channel stereophonic signal from the transceiver when the tips are inserted into the ear canals of the wearer such that the ear canals are substantially acoustically sealed.

14. The system of claim 9, wherein the transceiver is configured to be attachable to a portable device.

15. A wireless earphone system comprising:

a transceiver configured to wirelessly transmit a signal; and an earphone comprising:

a tip configured to be inserted into an ear canal of a wearer;

a housing;

a ground plane comprising circuitry; and a multi-segmented antenna configured to receive the signal from the transceiver, wherein the antenna and the ground plane are disposed within the housing, wherein the antenna is substantially parallel to the ground plane, and wherein the antenna and the ground plane are separated by a distance that is 5 millimeters or less, and wherein the ground plane is disposed at a first end of the housing, wherein certain portions of the circuitry protrude beyond the ground plane, and wherein the antenna follows a tortuous path around the portions of the circuitry protruding beyond the ground plane.

16. The system of claim 15, wherein the ground plane is disposed at a first end of the housing, wherein certain portions of the circuitry protrude beyond the ground plane, and wherein the antenna is disposed within the housing such that an upper surface of the antenna is at the same height or below the top height of the portions of the circuitry protruding beyond the ground plane, thereby allowing the antenna to be disposed within the housing without requiring an increase in the volume of the housing.

17. The system of claim 15, wherein the circuitry includes at least one of: a printed circuit board, a switch, a light emitting diode, and a charging socket.

18. The system of claim 15, wherein the antenna is c-shaped.

19. The system of claim 15, wherein the antenna has a total physical length that is about 57 millimeters or less and has an effective length that is about 32 millimeters or more.

20. The system of claim 15, wherein the earphone further includes a contact member configured to be attachable to the antenna, wherein during assembly of the earphone, the contact member guides antenna placement in the earphone.

21. The system of claim 15, wherein the housing has an external volume that is about 7700 cubic millimeters or less.

22. A wireless earphone system comprising:

a transceiver configured to wirelessly transmit a signal; and an earphone comprising:

a tip configured to be inserted into an ear canal of a wearer;

a housing;

a ground plane comprising circuitry; and a multi-segmented antenna configured to receive the signal from the transceiver, wherein the antenna and the ground plane are disposed within the housing, wherein the antenna is substantially parallel to the ground plane, and wherein the antenna and the ground plane are separated by a distance that is 5 millimeters or less, and wherein the antenna has a total physical length that is about 57 millimeters or less and has an effective length that is about 32 millimeters or more.

23. The system of claim 22, wherein the ground plane is disposed at a first end of the housing, wherein certain portions of the circuitry protrude beyond the ground plane, and wherein the antenna is disposed within the housing such that an upper surface of the antenna is at the same height or below the top height of the portions of the circuitry protruding beyond the ground plane, thereby allowing the antenna to be disposed within the housing without requiring an increase in the volume of the housing.

24. The system of claim 22, wherein the ground plane is disposed at a first end of the housing, wherein certain portions of the circuitry protrude beyond the ground plane, and wherein the antenna follows a tortuous path around the portions of the circuitry protruding beyond the ground plane.

25. The system of claim 22, wherein the circuitry includes at least one of: a printed circuit board, a switch, a light emitting diode, and a charging socket.

26. The system of claim 22, wherein the antenna is c-shaped.

27. The system of claim 22, wherein the earphone further includes a contact member configured to be attachable to the antenna, wherein during assembly of the earphone, the contact member guides antenna placement in the earphone.

28. The system of claim 22, wherein the housing has an external volume that is about 7700 cubic millimeters or less.

* * * * *